US006364690B1

(12) United States Patent
Nehm-Engelberts

(10) Patent No.: US 6,364,690 B1
(45) Date of Patent: Apr. 2, 2002

(54) CONNECTION METHOD AND CABLE CONNECTOR

(75) Inventor: Detlef Nehm-Engelberts, Wie Postanschrift (DE)

(73) Assignee: Phoenix Contact GmbH & Co., Blomberg (DE)

( * ) Notice: Subject to any disclaimer, the term of this patent is extended or adjusted under 35 U.S.C. 154(b) by 0 days.

(21) Appl. No.: 09/565,474

(22) Filed: May 5, 2000

(30) Foreign Application Priority Data

May 5, 1999 (DE) ..... 199 20 768

(51) Int. Cl.[7] ..... H01R 4/24
(52) U.S. Cl. ..... 439/412; 439/394; 439/405
(58) Field of Search ..... 439/405, 411, 439/412, 417, 582, 583, 580, 121, 114

(56) References Cited

U.S. PATENT DOCUMENTS 4,157,799 A * 6/1979 Simon ..... 248/56
4,746,307 A * 5/1988 Joly et al. ..... 439/394
6,019,627 A * 2/2000 Embo et al. ..... 439/412

FOREIGN PATENT DOCUMENTS

DE 42 12 805 9/1993
DE 42 38 224 2/1996
DE 195 04 013 7/1996
DE 198 52 489 3/2000
WO WO 97/06580 2/1997

* cited by examiner

*Primary Examiner*—Gary Paumen
*Assistant Examiner*—Alexander Gilman
(74) *Attorney, Agent, or Firm*—Nixon Peabody LLP; David S. Safran

(57) ABSTRACT

A cable connector (1) with a connection device (2) which is connected to a first conductor cable with a linking device (4) in a housing (3) used for insertion of a connection area (6) which is free of cable insulation (5) of a second cable (7) and for electrically connecting the first cable with the second cable (7) wherein the connecting device (2) and the linking device (4) are aligned so that the first cable and the second cable (7) are connected, preferably approximately rectangular to one another. In order to easily connect the first cable with the second cable (7), to a bipartite housing is provided having a lower housing part (8) and an upper housing part. In the lower housing part (8), there are a plurality of grooves (10) for the uptake of the wires (11) of the second cable (7), at least a part of the grooves (10) being oblique to the longitudinal axis (L) of the housing (3). Knife-switch prongs (12) are provided which have one of their ends directed toward the grooves (10) and are provided for cutting through the wire insulation and for connection to conductors in the second cable (7), the knife-switch prongs (12) being connectable to the conductors in the first cable with their second end.

15 Claims, 4 Drawing Sheets

CONNECTION METHOD AND CABLE CONNECTOR

BACKGROUND OF THE INFORMATION

1. Field of the Invention present invention relates to a method for connecting one conductor cable with a second conductor cable in an uninterrupted connection area free of cable insulation of the second cable using a cable connector wherein the cable connector is provided with a connecting device for connecting the first conductor cable and a linking device inside of a housing for insertion of the second cable in the cable connector and for electrically connecting the first cable with the second cable, wherein the connecting device and the linking device are aligned to one another so that the first and second cable are joined angularly, preferably approximately rectangular to one another. The present invention also relates to a cable connector having a connecting device for connecting a first conductor cable and a linking device inside of a housing for insertion of a connection area which is free of cable insulation of a second cable and for connecting the first cable with the second cable, wherein the connecting device and the linking device are aligned so that the first and second cable are joined angularly, preferably approximately rectangular to one another.

2. Description of the Related Art

A connecting method of the type mentioned above is an already-known prior art, as is the corresponding cable connector. These types of connectors are known in practice as so-called T-connectors. In those T-connectors known from practice, the connection of the first cable with the second cable is comparably complex. Generally, the second cable has to be taken apart in order to connect it with the first cable, the cable and individual wire insulation need to be removed. This is comparably complex.

SUMMARY OF THE INVENTION

The aim of the present invention is to provide a connecting method and a cable connector each of the type mentioned above, wherein in each case the connection of a first conductor cable with a second conductor cable is possible in a simple manner.

The task prefaced and described above is essentially accomplished according to the invention using a connecting method of the above-mentioned type, that after the removal of the cable insulation from the connection area of the second cable, the areas of the second cable provided with insulation are pushed together in the direction of the connection area so that individual wires fan out, that the fanned-out, insulated wires are each inserted in grooves of the lower housing part of the housing which are aligned at least partially obliquely to the longitudinal axis of the housing, that an upper housing part is placed on the lower housing part, and that as the cable conductor is pushed together, knife-switch prongs cut through the wire insulation of the individual wires of the second cable with one end and contact the conductors. The arrangement provides a housing made of two parts consisting of a lower housing part and an upper housing part, that a plurality of grooves for the insertion of wires from the second cable are provided in the lower housing part, that at least a part of the grooves, in any case, also have an area which is aligned obliquely to the longitudinal axis of the housing, that knife-switch prongs are provided which have one end directed at the grooves and which cut through the wire insulation and contact the conductor of the second cable as the cable connector is pushed together, and that the knife-switch prong is connectable to the conductor of the first cable with its second end.

The result of the invention is that a connecting method and a cable connector are provided wherein a connection of the first cable with the second cable is possible in a simple manner without separating the second cable. Through the fanning out of the wires from the connection area of the second cable and the fan-like arrangement of the wires in the housing, a connection is possible in a simple manner through the knife-switch prong. Due to the connection occurring through the knife-switch prong, it is not necessary to strip the open-ended conductors or wires of the connection area in order to produce an electrical connection with the first cable.

In order to keep the insulation-free connection area of the second cable as small as possible and to be able to ensure a simple manner for the fanning-out of the individual wires over the grooves in the lower housing part, the first and second cable openings on the housing which allow the second cable to pass through are shifted and have a substantially parallel alignment to one another. This shifted arrangement of the cable openings creates an "S" or wave shape of the grooves extending from the openings. The grooves are for the most part on one level so that in the active state, the wires are also arranged on one level. Due to the adjacently arranged individual wires, the grooved area of the housing has a width which is much greater than the diameter of the second cable.

In order to be able to insert the individual wires of the second cable in the lower housing part in a simple manner, the width of the individual grooves is smaller than the diameter of the individual wires. Hereby, clamping of the individual wires into the each groove simplifies the mounting of the wires. By the way, it is important for the inventive cable connector that the individual wires of the second cable are inserted in the "correct" grooves so that an electrical connection can be produced with the "correct" conductors of the first cable. In order to make a simple arrangement possible and to make optical examination possible, the individual grooves are assigned different colors or markings so that the danger of a misconnection between the conductors of the first and second cables is reduced.

In order to avoid damage to the linking points between the first and second cables due to an unintentional pull on the second cable, a traction relief which is operative on the cable insulation is provided in the area of the first and second cable openings. Occurring tractive forces are transferred to the housing through the traction relief. The linking points in the area of the knife-switch prongs are thus spared from the tractive forces operative on the second cable.

By the way, a length should be chosen for each sleeve-shaped traction relief that is longer than the diameter of the second cable. It is hereby ensured that each traction relief has a certain longitudinal stretch. The longitudinal stretch of the traction relief ensures that when the connection area is unintentionally made too large, i.e. too much cable insulation is removed, the second cable can be arranged in the housing in such a way than the traction relief is operative on the cable insulation.

It is preferred that the traction relief consists of two parts and that a first U-shaped segment is situated in the lower housing part and a second U-shaped segment is situated on the upper housing part. It is ensured through the bipartite construction and especially the U-shaped segment that the lower housing part can grasp onto the area of the second cable which has not been stripped of its insulation after the fanning-out of the wires.

After the fanning-out of the wires of the second cable and the arrangement of the fanned-out wires in the lower housing part, it is necessary to close the housing.

Therby, a reversible method should be chosen for connecting the two housing parts. For this purpose, the upper housing part should be able to be screwed onto the lower housing part. In order to be able to produce a screwing method which is simple and fast, the lower housing part is provided with external threading on the threaded joint section and a corresponding nut on the upper housing part is provided with internal, sectional threading. This method of screwing already provides an attachment after placing the nut on the threaded joint section and turning it slightly. In addition, or as an alternative to the said screwing method, it is also possible to connect the two housing parts using a threaded bore and screws. It is preferred to place the threaded bores each near the cable openings in order to push the traction relief down hard on the cable insulation. Should both screwing methods be used, the nut with internal, sectional threading should be screwed on first in order to achieve a preliminary attachment. After each individual screw is tightened into the threaded bores, the nut with internal, sectional threading should be screwed on further.

In order to provide a simple manner for connecting the first cable, the connecting device has a knife-switch prong carrier for the knife-switch prongs, a sleeve-shaped uptake with external threading, a central splicing part in the uptake with wire tractor channels to lead and curve the wires of the first cable and a union nut to screw onto the uptake. As the union nut is screwed onto the uptake, the knife-switch prongs dip down with their second end into a slot on the central splicing element which leads to the wire tractor channel, wherein the wire insulation of the individual wires is cut through and a contact is made with the conductor of the first cable.

In the preferred embodiment of the invention, the knife-switch prong carrier and the uptake are integrally constructed on the upper housing part. Thus, the upper housing part already forms a part of the connecting device.

The invention is further described in detail using the drawings showing a preferred embodiment.

DETAILED DESCRIPTION OF THE INVENTION

Figure 1:
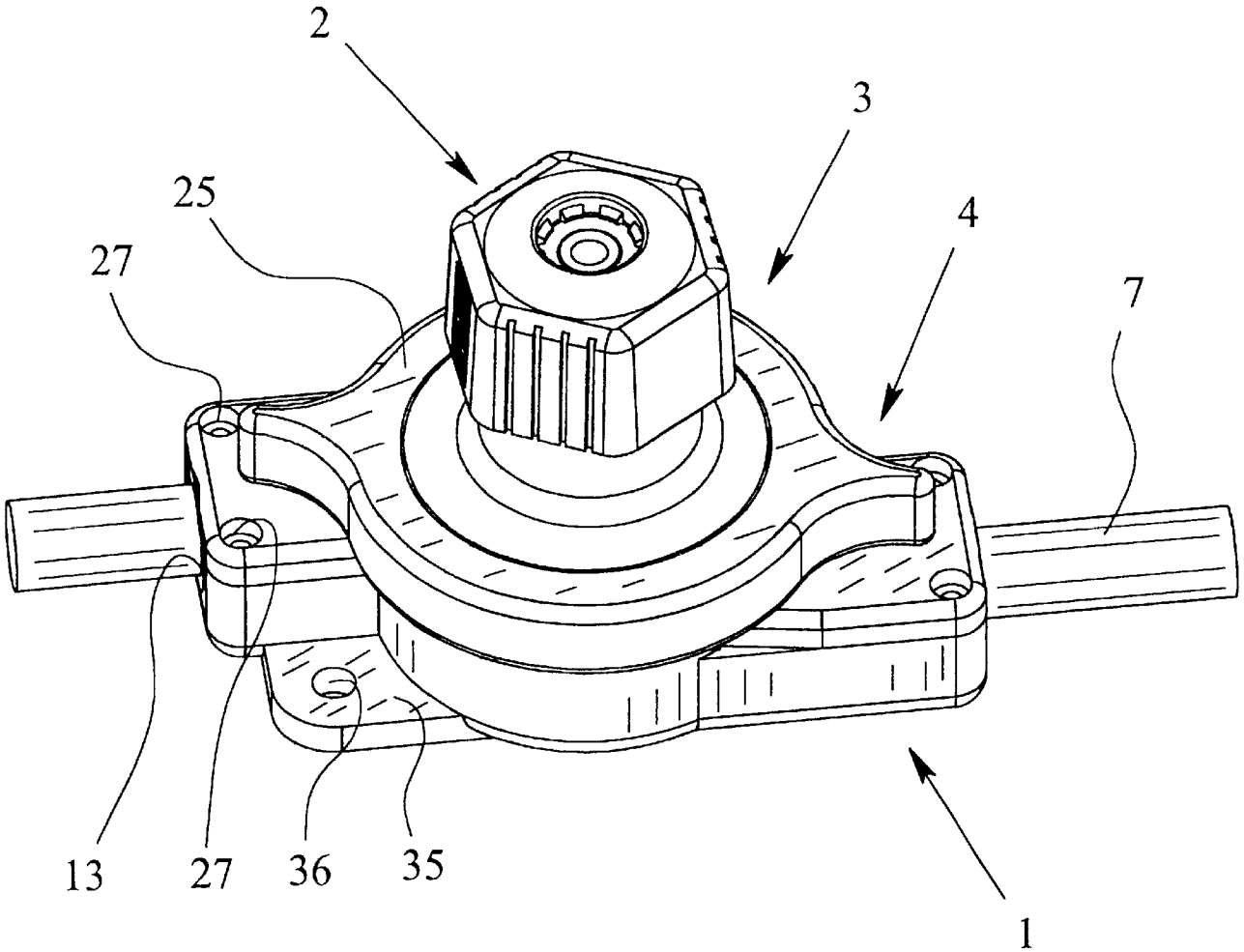
FIG. 1 is an overall perspective view of the cable conductor according to the invention.
Figure 2:
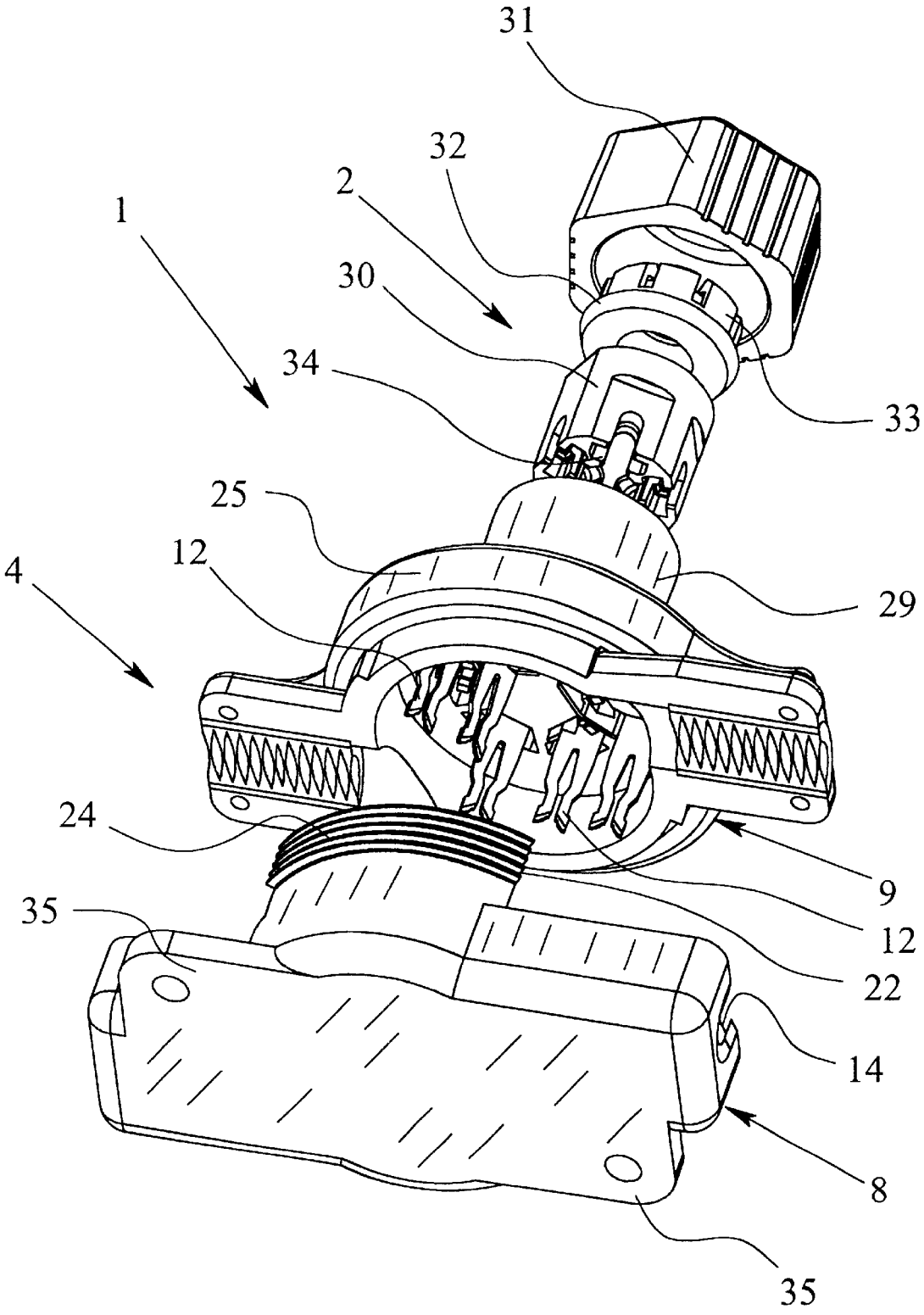
FIG. 2 is an exploded view of the cable connector in FIG. 1

A cable connector 1 is shown in FIGS. 1 and 2 which can be designated as a T-connector. The cable connector 1 has a connecting device 2 for connecting a conductor cable, which is not shown. The cable connector 1 is provided with a linking device 4 having a housing 3 for insertion of a connection area 6 which is free of cable insulation 5 of a second cable 7 and for electrically connecting the first cable with the second cable 7. The connecting device 2 and the linking device 4 are, in the pictured embodiments, aligned to one another so that the first cable and the second cable 7 are rectangular to one another. In principle, however, the arrangement is also possible using angles with different degrees.

Figure 4:
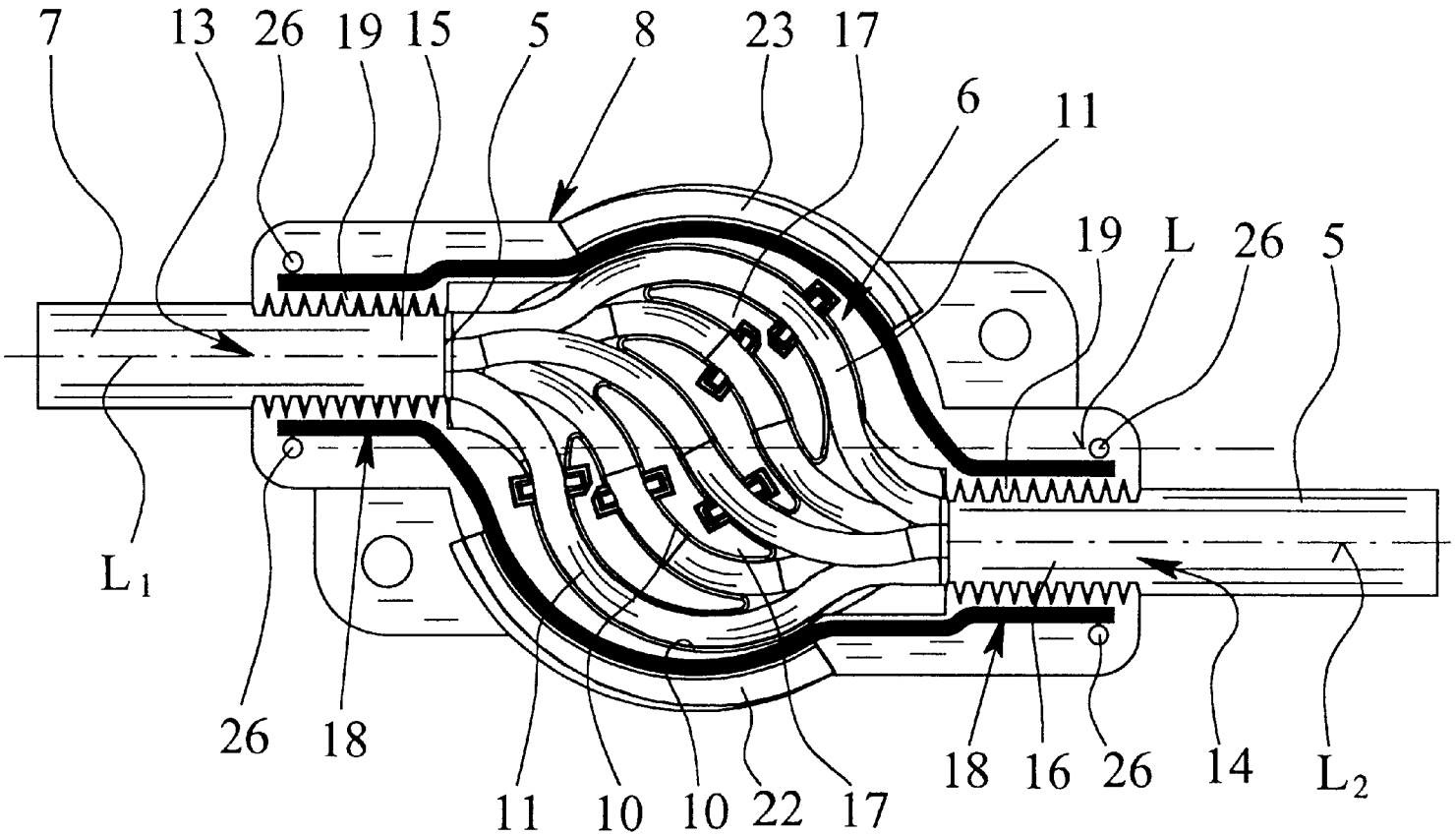
FIG. 4 is a top view of the lower housing part of the cable conductor according to the invention.

It is now essential that the housing 3 has a bipartite construction consisting of a lower housing part 8 and an upper housing part 9. The lower housing part 8 and the upper housing part 9 in this case are two separate pieces that are not directly connected to one another. As seen in FIG. 4, a plurality of grooves 10 are provided in the lower housing part 8 for the uptake of the individual wires 11 The individual grooves 10 are at least partially obliquely aligned to the longitudinal axis L of the housing 3. The grooves 10 and thus the individual wires 11 inserted in them cross the longitudinal axis L. The grooves 10 and the individual wires 11 inserted in them are at approximately the same level.

Figure 3:
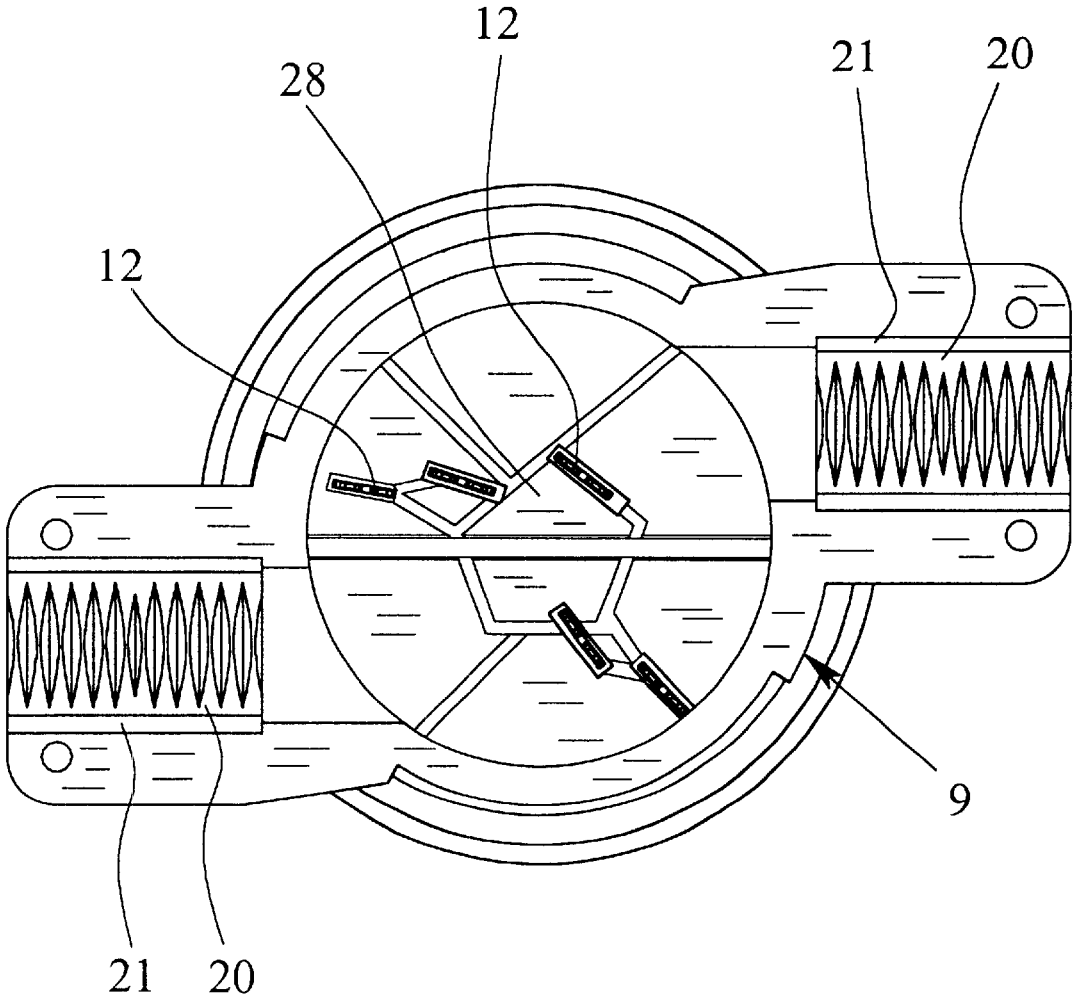
FIG. 3 is a top view of the upper housing part of the cable conductor according to the invention.

Furthermore, the cable connector 1 has a plurality of knife-switch prongs 12, as seen in FIGS. 2 and 3. The knife-switch prongs 12 are each directed toward the grooves 10 with one end and serve the purpose of cutting through the wire insulation of the wire 11 and connecting the conductor of the second cable 7 as the cable connector 1 is put together. The second ends of the knife-switch prongs 12 are each connectable with the conductors of the first cable, which is not shown separately.

The housing 3 has a first cable opening 13 and a second cable opening 14. As shown in FIGS. 3 and 4, the cable openings 13, 14 are laterally shifted and essentially parallel to one another. Accordingly, the longitudinal axes of the cable $L_1$, $L_2$ in the areas 15, 16 of the second cable 7, which are provided with cable insulation 5, are also parallel to one another and to the longitudinal axis L of the housing 3. Due to the shifted arrangement of the two cable openings 13, 14, the grooves 10 have an "S" or wave shaped alignment. The width of the grooves 10 is, at least on their lower area, less than the diameter of the individual wires 11, so that the fanned-out wires 11 of the connection area 6 are clamped into the grooves 10, as shown in FIG. 4. The number of grooves 10 corresponds to the number of individual wires 11 of the second cable 7. The grooves 10 are separated from each other by ledges 17. The individual ledges 17 end before coming to the cable openings 13, 14.

It is not shown, however, that the individual grooves 10 can have different colors or markings in order to make it possible to assign the individual wires 11 to particular grooves 10.

Sleeve-shaped traction reliefs 18, operational on the cable insulation 5 are provided near the first and second cable openings 13, 14. Each of the traction reliefs has a U-shaped segment 19 in the lower housing part 8 and a further segment 20 which slips on to the U-shaped segment on the upper housing part 9. Together, the segments 19, 20 create a sleeve-like traction relief. The U-shaped segment 19 makes possible a secure hold on the areas 15, 16 of the cable at the lower housing part 8, even when the upper housing part 9 has not yet been placed on the lower housing part 8. The segments 19, 20 of the traction relief 18 are held form-closed in the housing 3. At any rate, the segments 20 are fixed to the housing 3 with corresponding ledges. Each of the traction reliefs 18 has a saw-tooth shape for a secure fixation of the areas 15, 16 wherein the individual teeth each cut into the cable insulation 5. The length of the traction relief 18 is longer than the diameter of the second cable 7. The length of each said traction relief 18 is twice the size of the diameter of the second cable 7. Herewith, on the one hand, a secure fixation of the second cable 7 is achieved, and on the other hand, there is a tolerance balance when the length of the connection area 6 is too long, i.e., too much cable insulation 5 is removed in the connection area 6.

In the pictured embodiment, the lower housing part 8 and the upper housing part 9 can be screwed together. Two different screwing methods are provided. On the one hand, a method is provided in which opposite sides of the lower housing part 8 have a threaded joint section 22, 23 with external threading 24 protruding in the direction of the upper housing part 9. On the upper housing part, there is a nut 25 which has the shape of a wing nut for easier handling. The nut 25 has an internal, sectional threading which is not shown, so that both housing parts 8, 9 can be quickly screwed together after placing the upper housing part 9 on the lower housing part 8. On the other hand, two threaded bores 26 are provided on the lower housing part 8 near the cable openings 13, 14, each placed on an opposite side of the cable opening 13, 14. Along with the threaded bores 26, there are corresponding passage openings 27 on the upper housing part 9. Using screws, which are not shown, which can be screwed into the threaded bores, the two housing parts 8, 9 can be additionally screwed together, wherein at the same time there is a secure fixation of the second cable 7 in the areas 15, 16 near the traction relief 18.

The essential parts of the connecting device 2 are shown in FIG. 2. Basically, the connecting device 2 has a knife-switch prong carrier 28 on which the knife-switch prongs 12 are held. Furthermore, the connecting device 2 is provided with a sleeve-shaped uptake 29 which has an external thread that is not shown in detail. A splicing element 30 is provided in the uptake 29 with wire tractor channels which serve the purpose of leading and curving the wires of the first cable. In addition, a union nut 31 is provided which is screwed onto the uptake 29. Between the splicing element 30 and the union nut 31, there is a cylindrical flexible seal 32 which can be displaced radially and a crown-shaped pressure member 33 which is placed on the seal.

When screwing the union nut 31 onto the uptake 29, the strength from each individual shank of the crown-shaped pressure member 33 is axially and radially exerted which leads to a sealing of and traction relief on the first cable. It is, however, not shown that as the union nut 31 is screwed onto the uptake 29, the knife-switch prongs dip down with their second end into a slot 34 on the central splicing element 30 which leads to the wire tractor channels in the splicing element 30 which is also not shown. For the wires inserted in the splicing element 30, a movement of the splicing element toward the second end of the knife-switch prong leads to the wire insulation of the individual wires being cut through and to a connection with the conductor of the first cable.

With regard to the manner in which a connection is made in the area of the connecting device, the international application PCT/EP 96/03.292 can be referred to. The relevant content of this publication is used to avoid redundancies with regard to the formation of the connecting device 2 expressly as subject matter of the current application.

The pictured embodiment shows that the knife-switch prong carrier 28, the uptake 29 and the upper housing part 9 are integrally formed. This does not necessarily have to be the case. It is, basically, also possible that the connection device is made separately and connects the housing with the linking device.

In addition to the other attachments which are provided for the cable openings 13, 14, the housing 3 has a fastening section 35 with openings 36 with which the cable connector 1 can be attached to the wall or the floor.

The connection of the first cable with the second cable 7 occurs by removing the cable insulation 5 in an area of the second cable 7 for a determined length so that a connection area 6 free of cable insulation 5 and areas 15, 16 with cable insulation 5 exist. Areas 15, 16 are then each pushed together in the direction of the connection area 6 so that a fanning-out of the wires 11 results. Then, the fanned-out wires 11 are clamped into the corresponding grooves 10. At the same time, areas 15, 16 are pushed into the U-shaped segment 19 of the pull relief 18 until the state seen in FIG. 4 has been reached. The separation of the second cable 7 or the stripping of wire insulation from the individual wires 11 is not necessary.

In order to link the first cable with the connection device 2, the cable insulation is removed from one end of the first cable. After placing the union nut 31, the cylindrical flexible seal 32 and the crown-shaped pressure member 33 onto the first cable, the individual wires 11 of the first cable are inserted into the wire tractor channels in the splicing element 30. It is necessary, here, to pay attention that the individual wires are inserted in the "correct" wire tractor channels. A marking can be provided for marking the grooves of the wire tractor channels. Through the pushing of the individual wires of the first cable into the splicing element, the individual wires are curved. Then, the splicing element 30 can be inserted into the uptake 29 in which corresponding channels are provided for the splicing element 30. The union nut 31 is then screwed onto the uptake 29. In the process, the second end of the knife-switch prongs 12 enter the slot-shaped grooves 34 in the wire tractor channels, cut through the insulation of the individual wires and connect to the conductors of the first cable. At the same time, a seal and traction relief are established through the cylindrical flexible seal 32 and the crown-shaped pressure member 33.

The upper housing part 9 is then placed on the lower housing part 8, wherein a first screwed connection is produced through the threaded joint sections 22, 23 and the nut 25. Next, a second screwed connection occurs with screws, which are not shown, that are screwed into the threaded bores 26. After the production of this screwed connection, the nut 25 can be tightened.

What is claimed is:

1. Method for connecting a first conductor cable to a second conductor cable in an uninterrupted connection area, comprising the steps of:

providing a cable connector with a connecting device for connecting the first conductor cable to the second conductor cable and a linking device in a housing for receiving the second cable and for electrically connecting the first conductor cable to the second conductor cable, the linking device being arranged at an angle to the connecting device;

removing an outer cable insulation from the second cable in said connection area;

after removing the outer cable insulation in the connection area, pushing portions of the second cable at opposite sides of the connection area towards each other in a manner causing individual insulated wires of the cable to spread apart from each other;

inserting each of the spread apart individual insulated wires into a respective groove in a lower housing part of the housing extending at least partially obliquely to a longitudinal axis of the housing;

placing an upper housing part of the housing on the lower housing part in a manner causing knife-switch prongs of the cable connector to cut through the wire insulation of the individual wires of the second cable and connecting the second cable with the first cable.

2. Method for connecting a first conductor cable to a second conductor cable according to claim 1, wherein said inserting step is performed with portions of said second conductor cable at opposite ends of said separated individual wires being oriented essentially parallel to each other and laterally offset relative to each other, and with the separated individual wires in a wave-shaped arrangement, conductor cables together.

3. A cable connector with a connecting device for connecting the first conductor cable to the second conductor cable and a linking device having a housing for receiving the second cable and for electrically connecting the first conductor cable to the second conductor cable, the linking device being arranged at an angle to the connecting device; wherein the housing comprises upper and lower housing parts; wherein a plurality of wire-receiving grooves are provided in the lower housing part, each of said grooves receiving an individual insulated wire of the second cable and being obliquely oriented, at least in part, relative to a longitudinal axis of the housing and having a wave shape; and wherein the connecting device has knife-switch prongs which are provided in the upper housing part, said knife-switch prongs being connectable to said first conductor cable at a first end and a second end of the knife-switch prongs being directed toward said grooves so as to engage and separate the wire insulation of the individual insulated wires of the second conductor cable when the housing parts are secured together, thereby electrically connecting the conductor cables together.

4. Cable connector according to claim 3, wherein each of said grooves has a length which is greater than a longitudinal distance between the first opening and second openings for the second conductor cable of the housing.

5. Cable connector according to claim 3, wherein the housing has a first opening for the second conductor cable and a second opening for the second conductor cable, said first and second openings being essentially parallel to each other and laterally offset relative to each other.

6. Cable connector according to claim 3, wherein each of the grooves has a width that is smaller that a diameter of individual wires of the second conductor cable.

7. Cable connector according to claim 3, wherein each of the grooves has an identifier for indicating which of the individual wires of the second conductor cable is to be inserted therein.

8. Cable connector according to claim 5, wherein a traction relief is provided near at least one of said first and second openings for acting on an outer cable insulation of the second conductor cable.

9. Cable connector according to claim 8, wherein said traction relief has a length that is longer than a diameter of the second conductor cable.

10. Cable connector according to claim 8, wherein the traction relief has a U-shaped segment on the lower housing part and a slip-on segment in the upper housing part that fits onto the U-shaped segment.

11. Cable connector according to claim 5, wherein the lower housing part has a protruding threaded joint section that is threadably engageable with a nut on the upper housing part for joining the upper and lower housing parts together.

12. Cable connector according to claim 11, wherein the upper and lower housing parts are securable together near the cable openings by screws on one of the housing parts engaging threaded openings in the other of the housing parts.

13. Cable connector according to claim 5, wherein the upper and lower housing parts are securable together near the cable openings by screws on one of the housing parts engaging threaded openings in the other of the housing parts.

14. Cable connector according to claim 3, wherein the connecting device has a knife-switch prong carrier, a sleeve-shaped uptake with external threading, a splicing element in the uptake with wire tractor channels for leading and curving the wires of the first conductor cable, and a union nut which is threadable onto the uptake; wherein a first end of knife-switch prongs on the knife-switch prong carrier extend down into a slot leading to wire tractor channels inside of the splicing element for separating wire insulation of the individual insulated wires and electrically connecting them to conductors of the first conductor cable when the union nut is screwed onto the uptake.

15. Cable connector according to claim 14, wherein the knife-switch prong carrier and the uptake are integrally formed on the upper housing part.

* * * * *